US005293524A

United States Patent [19]

Mookerjee et al.

[11] Patent Number: 5,293,524

[45] Date of Patent: Mar. 8, 1994

[54] UNIFORMLY WOUND SUPERCONDUCTING COIL AND METHOD OF MAKING SAME

[75] Inventors: Sumit Mookerjee, Cedar Hill, Tex.; Shen Weijun, Beijun, China; Billy Yager, Waxahachie, Tex.

[73] Assignee: The United States of America as represented by the Department of Energy, Washington, D.C.

[21] Appl. No.: 964,760

[22] Filed: Oct. 15, 1992

[51] Int. Cl.[5] ..... H01F 1/00

[52] U.S. Cl. ..... 335/216; 335/299; 335/300; 174/126.1; 174/128.1; 29/599; 336/96

[58] Field of Search ..... 335/216, 299, 300; 174/126 S, 128 S; 79/599; 29/599, 605; 336/96

[56] References Cited

U.S. PATENT DOCUMENTS

H383 12/1987 Skaritka ..... 29/599
4,255,849 3/1981 Beck ..... 29/599
4,561,175 12/1985 Kawasumi ..... 29/605
4,679,020 7/1987 Kawamura et al. ..... 335/216

*Primary Examiner*—David C. Cain
*Attorney, Agent, or Firm*—Daniel D. Park; Thomas G. Anderson; William R. Moser

[57] ABSTRACT

A coil of superconducting wire for a superconducting magnet having a relatively dense and uniformly spaced winding to enhance the homogeneity and strength of the magnetic field surrounding the coil and a method of winding the same wherein the mandrel used to wind said coil comprises removable spacers and retainers forming a plurality of outwardly opening slots, each of said slots extending generally about the periphery of the mandrel and being sized to receive and outwardly align and retain successive turns of the superconducting wire within each slot as the wire is wound around and laterally across the mandrel to form a plurality of wire ribbons of a predetermined thickness laterally across the mandrel.

17 Claims, 5 Drawing Sheets

UNIFORMLY WOUND SUPERCONDUCTING COIL AND METHOD OF MAKING SAME

CONTRACTUAL ORIGIN OF THE INVENTION

The United States Government has rights in this invention pursuant to Contract No. DE-AC02-89ER40486 between the U.S. Department of Energy and the University Research Association, Inc.

BACKGROUND OF THE INVENTION

The present invention relates to a method of winding a coil of superconducting wire for a superconducting magnet, and, more particularly, to a winding arrangement wherein the windings of the coil are uniform and dense, such that the resulting superconducting magnet produces a strong and homogeneous magnetic field and yet is physically compact and energy efficient.

Superconducting magnets and the methods of their manufacture are well known in the art. At cryogenic temperatures, superconducting wire loses virtually all ohmic resistance and allows the free flow of electricity for long periods of time and in very high current densities. Because the current density in a superconducting coil can be hundreds of times higher than in nonsuperconducting coils, very strong magnetic fields can be obtained, and, as a result, superconducting magnets have found extensive application in devices such as high energy particle accelerators, plasma confining tokamaks, synchrotron radiation sources, nuclear magnetic resonance imaging systems, and magnetic levitation devices. However, due to continuous demands for greater power and accuracy of these devices, there is a continual need for a more efficient superconducting magnet which can provide stronger and more homogeneous magnetic fields and at the same time is physically more compact and requires less power.

A prime example of the application of more efficient superconducting magnets is in the construction of the Superconducting Super Collider (SSC) particle accelerator which will use thousands of superconducting magnets to bend and focus high energy particle beams in a generally circular orbit. Although the main superconducting magnetic coils of the SSC are designed to exhibit minimal magnetic field harmonics, due to superconductor magnetization effects, iron saturation and coil positioning errors, certain harmonic errors are possible which must be corrected with multipole corrector or adjustment coils. Additionally, multipole corrector coils are utilized to focus the particle beam into a desired stream, so as the energy of the particles increases, the strength of the corrector coils must likewise be increased. Therefore, there is a need for corrector coils which can provide strong and homogeneous magnetic field and, yet, are compact and energy efficient.

Although the use of corrector coils to correct magnetic field deviations and to focus the particle beam is well known, the production and use of these coils are complicated by a number of factors. First of all, the superconducting wires utilized in the windings are typically of very small diameter and are generally more brittle than normal conductors, so therefore greater care must be exercised in the winding and forming of such superconducting magnets. Another factor is that the coils are very lengthy (more than a meter in length) while the spacing between the adjacent turns of the coil must be precisely maintained, so it is difficult and time consuming to wind uniform layers of wire which are physically stable so as to prevent generation of frictional heat from coil movement resulting from the electromotive forces of the large currents. Additionally, the coils must be physically compact so that it may easily be cooled to cryogenic temperatures.

Until now, such correction coils have been randomly wound around a mandrel to obtain the coils of desired length and then shaped into desired configurations to fit around the bore tube. However, because the windings of these previous coils were not essentially uniform, the magnetic fields they generated were neither as homogeneous or as strong as desired.

As can be seen from the foregoing, one of the requirements for an efficient superconducting magnet is that it have a uniform, homogeneous cross-section with a high density of superconducting wire within its cross-sectional area. As the windings are made more uniform and with greater cross-sectional density, the magnetic field produced by the windings is stronger and more homogeneous. This also means that the resulting superconducting magnet requires less energy and, yet, is physically more compact. These advantages would also facilitate greater flexibility in the positioning of these corrector coils about the bore tube and make it easier to cryogenically cool the same.

In nuclear magnetic resonance (NMR) imaging, homogeneous magnetic fields are required to obtain optimum image data. Although the main magnetic coil of a NMR imaging system is designed to produce a homogeneous a magnetic field as is possible, some spatial deformity is inevitable, and it is standard practice to utilize corrector coils to perturb the magnetic flux pattern to increase the overall homogeneity of the magnetic field. However, the process of measuring the magnetic field deformity and calculating the positioning and magnitude of the corrector coil current is a tedious and time consuming process. Therefore, a corrector coil that produces a more homogeneous magnetic field would simplify and speed-up the correcting process.

Likewise, in constructing synchrotron radiation and magnetic levitation devices, it is essential to have compact and efficient superconducting magnets which can produce strong yet homogeneous magnetic fields.

In view of the foregoing, the general object of this invention is to provide a method of winding a coil of superconducting wire for a superconducting magnet having a relatively dense and uniformly spaced windings to enhance the homogeneity and strength of the magnetic field produced by the superconducting magnet.

Another object of this invention to provide a mandrel for winding a coil of superconducting wire for a superconducting magnet having a relatively dense and uniformly spaced windings.

Yet another object of this invention is to provide a coil of superconducting wire having relatively dense and uniformly spaced windings.

Additional objects, advantages and novel features of the invention will become apparent to those skilled in the art upon examination of the following and by practice of the invention.

SUMMARY OF THE INVENTION

To achieve the foregoing and other objects, this invention provides a method and apparatus for winding a coil of superconducting wire to form a superconducting magnet having a relatively dense and uniformly spaced winding to enhance homogeneity and strength of the magnetic field surrounding the coil.

The method includes winding the superconducting wire about a mandrel having a plurality of outwardly opening, laterally parallel slots extending about the periphery of the mandrel which are sized to receive and outwardly align and retain successive turns of the superconducting wire in each slot as the wire is wound around and laterally across the mandrel to form and retain the coil about the mandrel. Next, the turns of the superconducting wire are bonded together to form an integral ribbon of wire within each of the slots, whereafter the mandrel is disassembled to facilitate removing the coil from the mandrel while retaining its wire ribbon configuration. Thereafter, the coil is bent to align the coil ribbons in a pre-established configuration and subsequently bonded to secure the ribbons to form the coil.

The mandrel about which the superconducting wire is wound comprises removable spacers and retainers which cooperate to form the outwardly opening slots noted above. This arrangement has been found to be particularly suited for coil fabrication as it is readily adaptable for sizing the slots to facilitate winding the superconducting wire around and laterally across the mandrel to form the wire ribbons while at the same time maintaining a predetermined thickness for each of the ribbons and providing an arrangement from which the coil can be readily disengaged without damage.

As can be seen from the foregoing, the resulting coil of superconducting wire comprises windings formed into a plurality of wire ribbons along the lateral width of the coil. Each of the wire ribbons includes a predetermined number of wire turns which are bonded together to form the ribbons. These ribbons are in turn aligned and bonded in an essentially side-by-side parallel fashion along the thickness of the coil to form a coil having a predetermined cross-sectional profile, shaped and bonded into a predetermined configuration to obtain desired magnetic field densities.

DESCRIPTION OF THE PREFERRED EMBODIMENT

Figure 1:
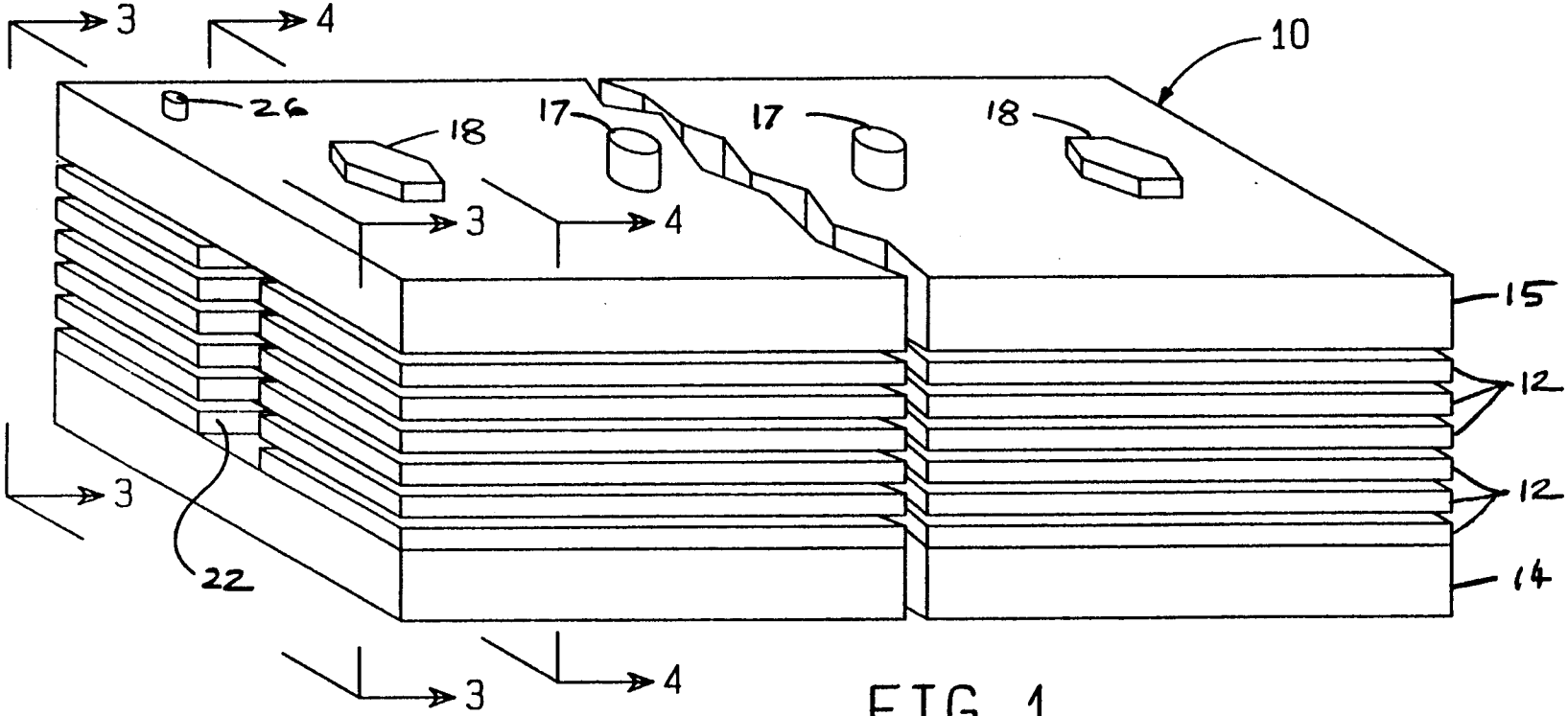
FIG. 1 is a partial pictorial view of the mandrel of the present invention after it has been assembled.
Figure 2:
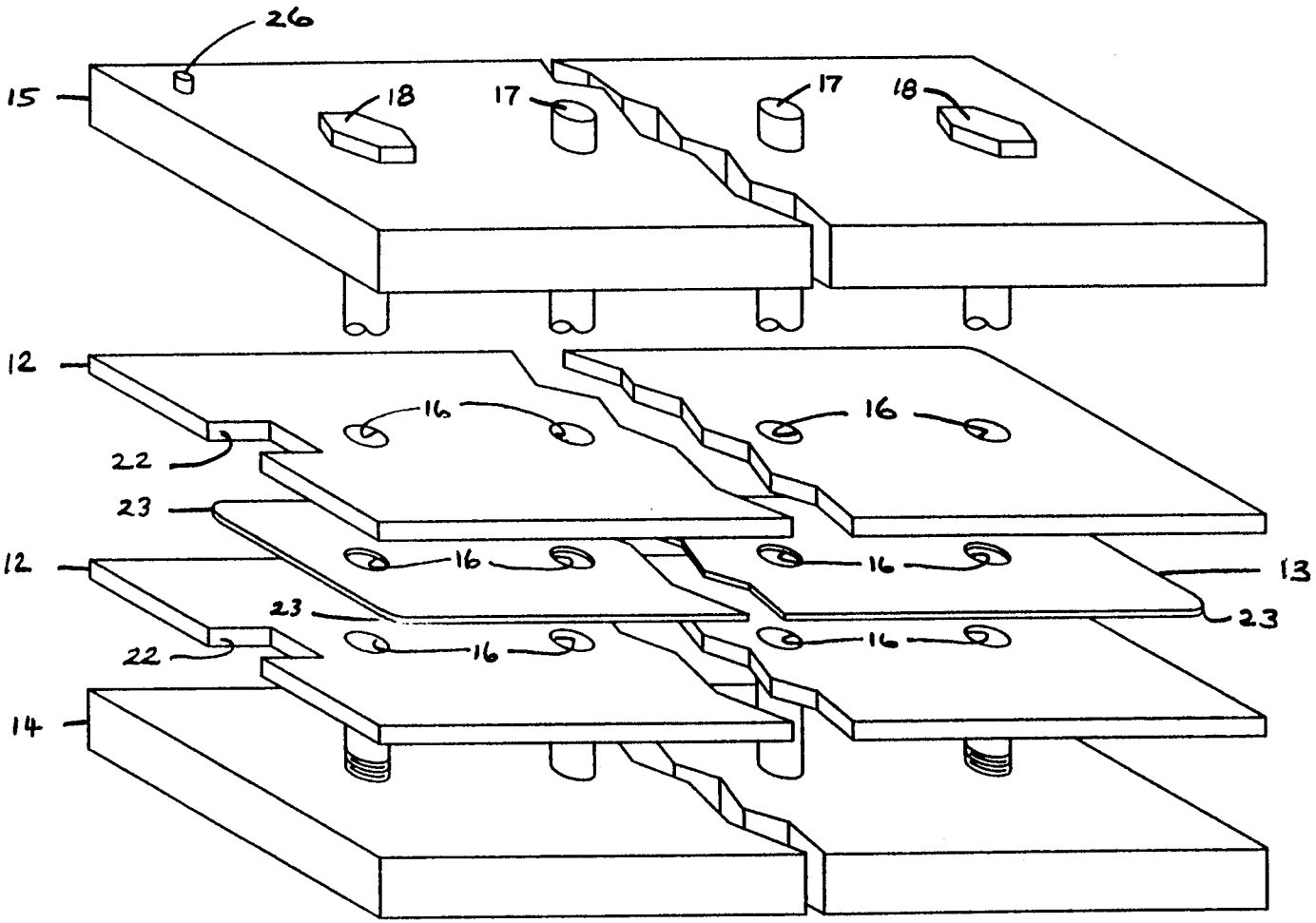
FIG. 2 is a exploded partial pictorial view of the mandrel shown in FIG. 1.

As shown in the drawings, the invention calls for using a mandrel assembly 10 to wind a uniform and dense coil 1 of superconducting wire 11 for a superconducting magnet. The mandrel 10 includes a plurality of spacer plates 12 and mandrel or spool plates 13 sandwiched between one another in alternating layers and secured together between two base or supporting end plates 14 and 15. As shown in FIG. 2, a plurality of equally spaced and cooperatively aligned holes 16 sized to receive dowels 17 are provided in the spacer plates 12, mandrel plates 13, and base or end plates 14 and 15 for aligning the plates. Thereafter, a pair of bolts 18 are inserted through the remaining holes 16 and threaded into the correspondingly aligned holes 19 tapped into the base plate 14 to secure the mandrel assembly together as shown in FIG. 1.

Assembly of the mandrel 10 is performed by laying out the first base plate 14 and placing dowel pins 17 into the corresponding holes 16 in the first base plate 14. Next, a spacer plate 12 is placed adjacent to the first base plate 14, being guided and aligned by dowel pins 17 inserted into the holes of the first base plate 14. Next, one of the mandrel plates 13 is placed adjacent to the spacer plate 12, being also guided and aligned by the same dowel pins 16. The foregoing sequence of placing alternating layers of spacer and mandrel plates is continued until the desired thickness of the mandrel is achieved, which, of course, depends on the lateral thickness of the coil to be formed. Thereafter, a second base or end plate 15 is placed adjacent to the final tier of the mandrel plate 13 and the mandrel assembly is secured together with the bolts 18 as noted above. In this connection, it is to be understood that any one of a variety of releasable fasteners can be used for this purpose in lieu of bolts or the like.

Figure 3:
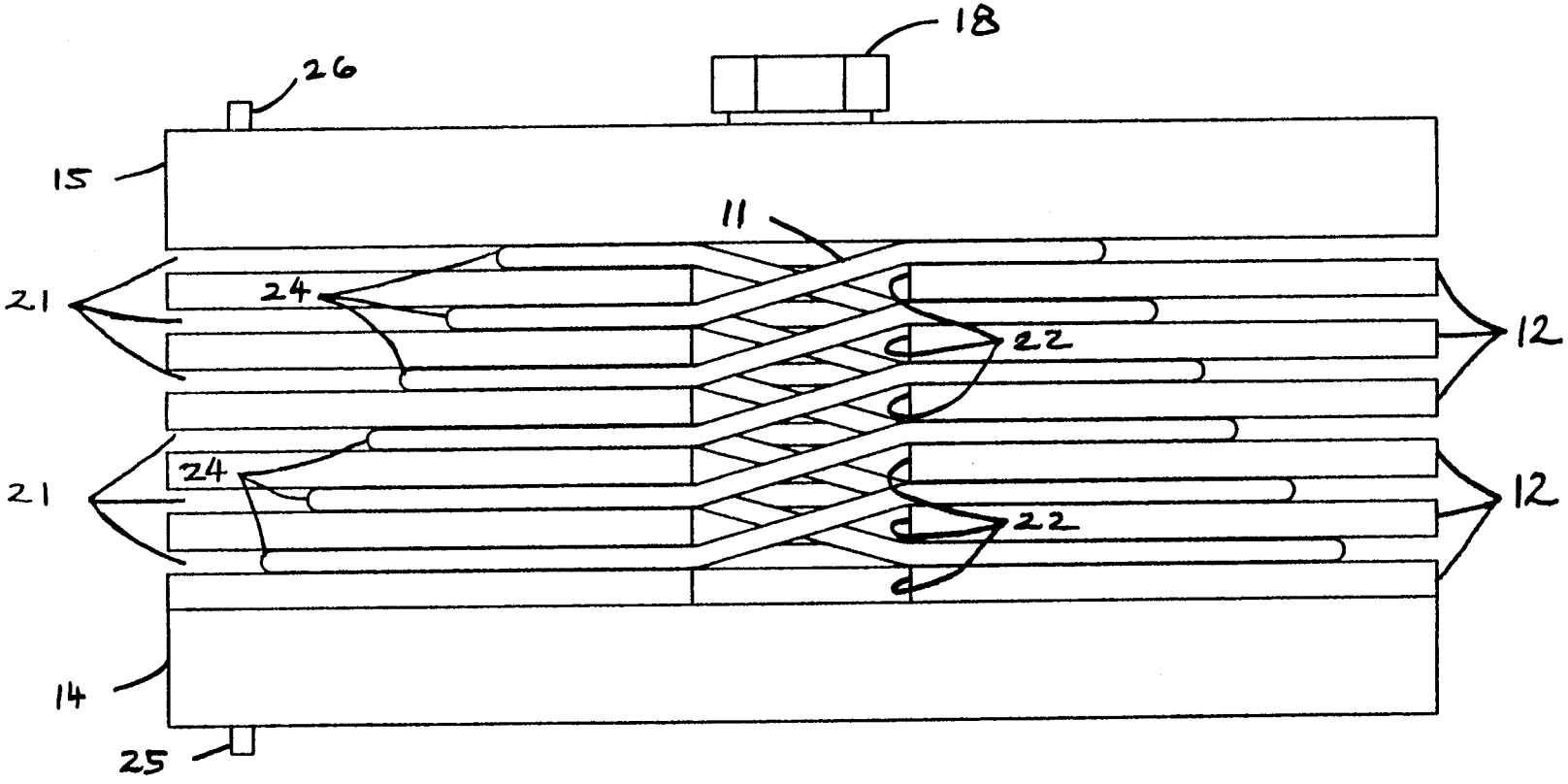
FIG. 3 is a cross-sectional view of the mandrel taken substantially along line 3—3 in FIG. 1 showing the superconducting wire as it is wound on the mandrel.
Figure 4:
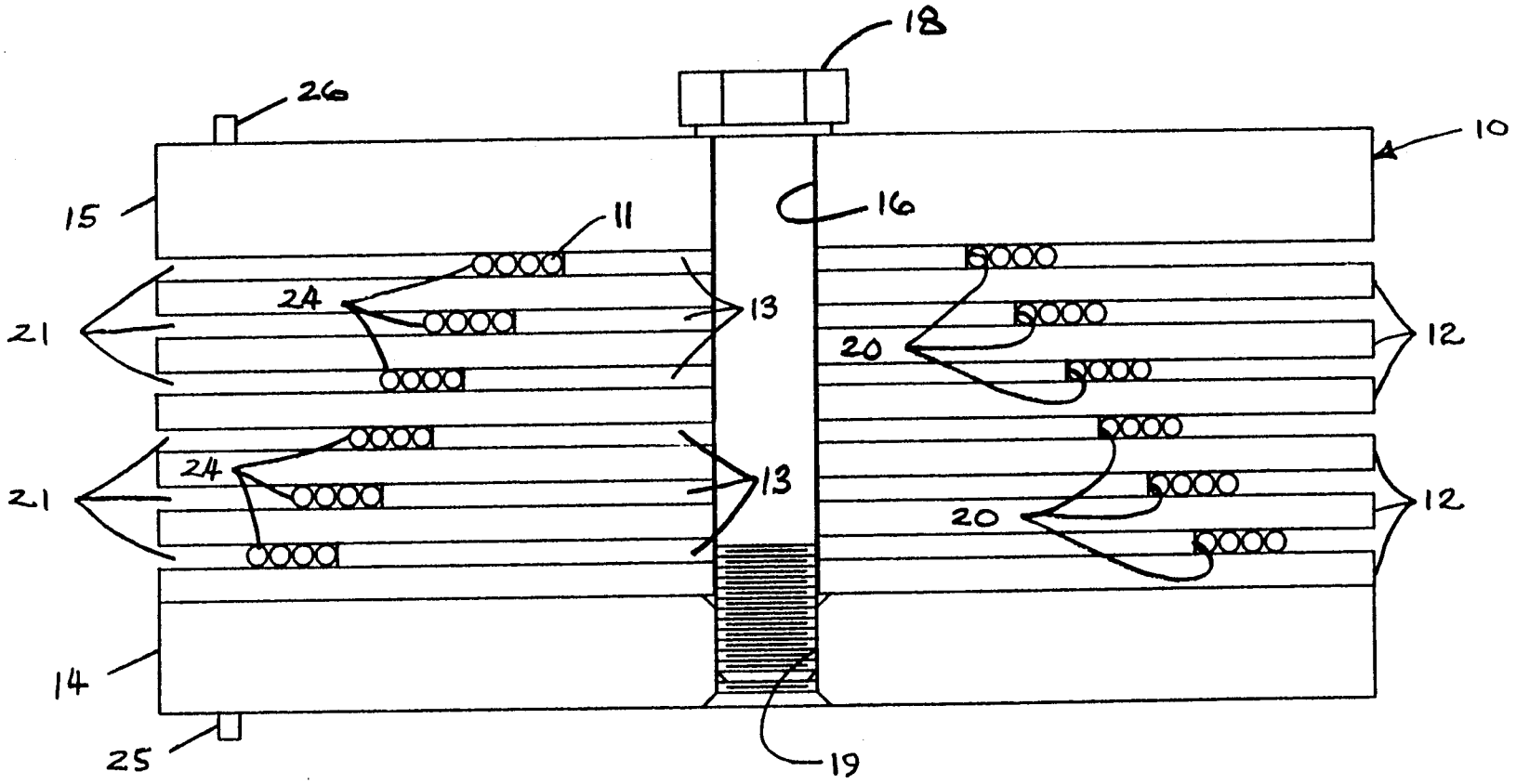
FIG. 4 is a cross-sectional view of the mandrel taken substantially along line 4—4 in FIG. 1 showing the ribbon-like configuration of the windings of the superconducting wire as it is wound on the mandrel.
Figure 5:
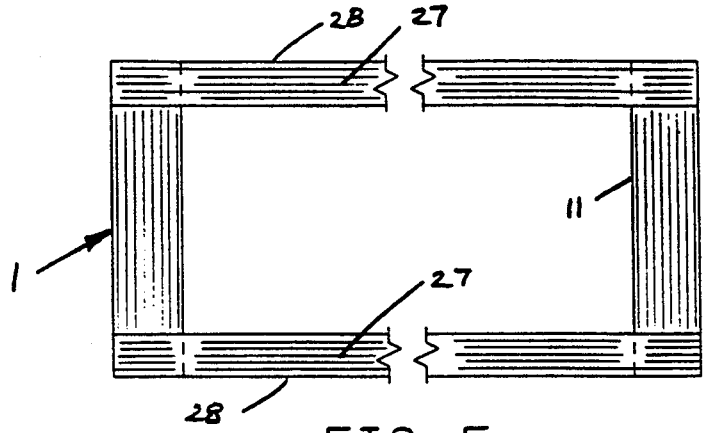
FIG. 5 is a partial plan view of a superconducting coil fabricated according to the invention.
Figure 7:
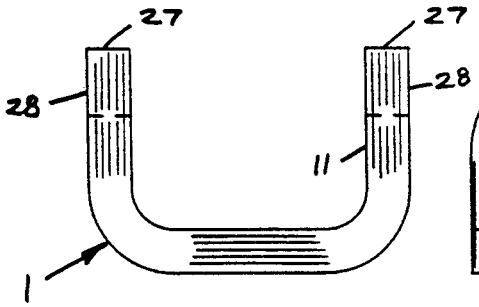
FIG. 7 is an end view of the coil in FIG. 6.
Figure 6:
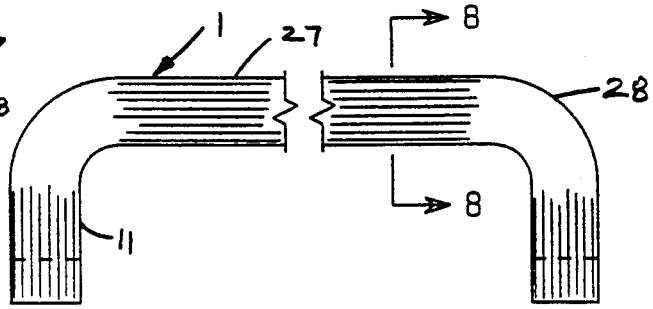
FIG. 6 is a lateral side view of the coil shown in FIG. 5.

FIGS. 3 and 4 illustrate one embodiment of the mandrel 10 showing several turns of a superconducting wire 11 wound about the mandrel. In the preferred embodiment, the size of the base plates 14 and 15 and the spacer plates 12 is substantially the same. However as can be seen from the drawing, mandrel plates 13 are smaller, so that, when placed in alternating layers with the spacer plates, the mandrel plates form a spool 20 tapered along its sides in an essentially trapezoidal cross-sectional configuration which defines the inner periphery of a plurality of outwardly opening parallel slots 21, extending generally about the periphery of the mandrel. Each of the slots 21 is sized to receive, retain and outwardly align successive turns of the superconducting wire 11 in an essentially ribbon-like configuration during fabrication of the coil 1. Also, as illustrated in FIGS. 2 and 3, the spacer plates 12 are each provided with notches 22 for passing the turns of the superconducting wire 11 between adjacent slots 21 as the coil is wound, and the corners 23 of the mandrel plates 13 are rounded to minimize interference with the wire as it is wound on the mandrel assembly.

FIGS. 3 and 4 best illustrate the relative thicknesses of the various plates used to assemble the mandrel 10. The thickness of the mandrel plates 13 is slightly greater than the thickness of the wire 11 to allow the turns of the coil to be wound into single layer wire ribbons 24 within the slots 21, although it should be noted that in some embodiments it may be appropriate to form the wire ribbons in layers of two or more wires depending on the material characteristics of the wire. In either event, the thickness of the spacer plates 12 is such that they properly separate and support the wire turns as each ribbon is formed. The thickness of the base plates 14 and 15 is such that they properly support and provide rigidity to the mandrel assembly 10 as the wire 11 is first wound and later bonded together.

The various components of the mandrel 10 including spacer plates 12, mandrel plates 13 and base plates 14 and 15 are preferably constructed of the same or similar materials having substantially the same heat expansion characteristics as that of the wire 11 used to wind the coils. As will be appreciated, this facilitates the use of heat bonding or fusing techniques during fabrication of the coil without damaging the superconducting wire due to differing heat expansion characteristics of the materials. The superconducting wire 11 used to wind the coil 1 is preferably formed of a small diameter superconductor wrapped in a thin layer of insulating resin such as Kapton insulation (Kapton is a trademark of Westinghouse Electric Corporation) which is then overlaid with a thin layer of heat activated high temperature plastic adhesive such as those sold under the Bondall or XMPI trademarks (Bondall and XMPI are trademarks of E.I. DuPont de Nemours & Co.). The adhesive provides a means for bonding the turns of the superconducting wire 11 into a solid and rigid coil of wire, thereby obviating the necessity for the difficult and laborious process of impregnating the coil with resin or silicon rubber to attain structural stability as has typically been used in the past. The superconducting wire used for the coil in this case may be any one of a variety of commercially available wire types such as 2.2 ratio wire manufactured by Outokompu or Barcel Cable and Wire Companies.

Referring to FIGS. 1–4, when winding the superconducting coil 1, the lead end of the superconducting wire 11 is attached to the first base plate 14 of the mandrel 10 by means of a bobbin 25 or other such conventional device affixed to the outer edge of the mandrel 14. Thereafter, the wire 11 is wound around the mandrel 10 within the slots 21 defined by the alternating spacer and mandrel plates 12 and 13. While winding, sufficient tension is maintained in the wire 11 to attain smooth and dense windings within each slot 21. After each revolution or turn of the wire 11 about the mandrel 10 within each slot 21, the wire is guided through the outwardly opening notch 22 in the end of the respective spacer plate 12 to reach the next adjacent slot 21. This process of winding the wire 11 is continued laterally across the mandrel 10 until all slots 21 of the mandrel 10 have been wound with a like turn of wire 11. Thereafter, the wire 11 is wound in a like manner in the opposite direction laterally across the mandrel 10, continuing this process until the desired number of turns, or thickness of the coil to be formed, is attained. Once winding has been completed, the superconducting wire 11 is cut from its spool and attached to the second base plate 15 by means of a second bobbin 26.

After the coil has been fully wound about the mandrel 10, the entire assembly is placed into an oven at an appropriate temperature for a period of time sufficient to activate the heat activated adhesive coating on the superconducting wire to bond the windings of the superconducting wire 11 together in ribbons 24. Using the adhesive noted above, the coil was heated to about 250° F. for four hours. Additionally, if deemed appropriate due to the nature of the wire, removable shims (not shown) having substantially the same thickness as the wire 11 may be inserted into the slots 21 on the four sides of the mandrel to provide additional restraints to hold the windings in each slot in position while they are being heated to bond them together. As in the case of the other mandrel components, the shims should be made of a material whose thermal expansion characteristics are substantially the same as that of the wire 11.

Following the foregoing bonding process, the mandrel 10 is disengaged from the partially completed coil 1 without disturbing the coil's ribbon-like configuration. Removal of the mandrel components is accomplished by first removing the bolts 18 and removing the second base plate 15. Next, the pins 17 are slid out of the assembly. Thereafter, the spacer plates 12 are carefully separated from the coil windings and withdrawn from the assembly at the end opposite from the notches 22. Then, mandrel plates 13 are removed, beginning with the largest plate, until all of the mandrel plates 13 have been removed.

After disengagement of the partially completed coil 1 from the mandrel 10, the coil is shaped into an elongated, U-shaped configuration to obtain the desired magnetic field densities as shown in FIGS. 5–8. Preferably, a suitable jig or holder (not shown) is used to shape and retain the coil during this step of the fabrication process. In any event, it should be noted that the particular configuration selected depends on the desired magnetic field characteristics. Thereafter, the coil is again placed into an oven at an appropriate temperature for a period of time sufficient to fuse the heat sensitive plastic adhesive to bond the windings of the superconducting wire together in the desired configuration. In this case, the coil was again heated to about 250° F. for four hours.

Figure 8:
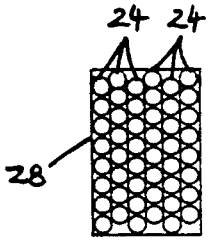
FIG. 8 is an enlarged cross-sectional view of the coil taken substantially along line 8—8 in FIG. 6.

As best shown in FIG. 8, the coil 1 comprises windings formed into a plurality of wire ribbons 24 across the thickness of the coil, wherein each of the ribbons includes a predetermined number of wire turns which are laterally aligned and bonded together in an essentially side-by-side parallel fashion to the other ribbons across the thickness of the coil. It should be particularly noted that the ribbons 24 have been positioned to form relatively flat ends 27 on the side legs 28 of the coil when it is bent into its final configuration. This has been accomplished by appropriately sizing the lateral width of the mandrel plates 13 to form the tapered spool indicated at 20, although it is to be understood that other desired end profiles (i.e. curves, slopes or the like) can be obtained by selectively sizing the lateral width of the mandrel plates.

The resulting coil 1 of superconducting wire 11 comprises an essentially uniform and dense winding of wire which enhances the homogeneity and strength of the magnetic field produced by the coil. Likewise, the efficiency of the coil is improved, allowing for the operation of the superconducting magnet at reduced currents and in a physically more compact form. The invention is particularly suited for producing superconducting magnets used in high energy particle accelerators, plasma confining devices for nuclear fusion, synchrotron radiation sources, nuclear magnetic resonance imaging systems, magnetic leviation devices and related uses where precision and control of magnetic fields is particularly critical. The embodiment disclosed is particularly suited for use as a corrector coil in a particle accelerator to correct and adjust the magnetic field of the main superconducting coils and focus high energy particle beams into a stream of particles suitable for experimentation.

The foregoing description of a preferred embodiment of the invention has been presented for purposes of illustration and description. It is not intended to be exhaustive or to limit the invention to the precise form disclosed. For example, some of the superconducting coils contemplated by this invention may include several hundred, and in some cases several thousand, turns of superconducting wire wound on an expanded mandrel having many more slots and being otherwise adapted to wind a coil of that size and nature as will be readily apparent. The embodiment described herein explains the principles of the invention so that others skilled in the art may practice the invention in various embodiments and with various modifications as suited to the particular use contemplated. It is intended that the scope of the invention be defined by the claims appended hereto.

The embodiment and the method of the invention in which an exclusive property or privilege is claimed are defined as follows:

1. A method for forming a coil of superconducting wire for a superconducting magnet having an essentially dense and uniformly spaced winding to enhance homogeneity and strength of the magnetic field surrounding the coil including the steps of:

winding said superconducting wire about a mandrel, said mandrel including removable spacing and retaining means forming a plurality of outwardly opening laterally parallel slots, each of said slots extending generally about the periphery of the mandrel and being sized to receive and outwardly align and retain successive turns of the superconducting wire within each slot as the wire is wound around and laterally across the mandrel to form a plurality of wire ribbons of a predetermined thickness laterally across the mandrel;

effecting first bonding means to bond the turns of the superconducting wire together within each of the slots to form an integral ribbon of wire;

disassembling the mandrel by removing the spacing and retaining means to disengage the coil from the mandrel;

bending the coil to align the coil ribbons in a preestablished configuration; and effecting second bonding means to secure the coil ribbons in said preestablished configuration.

2. The method of claim 1, wherein the successive turns of the superconducting wire within each slot are wound into a wire ribbon formed of a single layer of outwardly adjacent turns.

3. The method of claim 1, wherein said slots formed by said removable spacing and retaining means are laterally aligned in a fashion adapted to retain and align the respective ribbons of superconducting wire in a predetermined cross-sectional profile.

4. The method of claim 1, wherein the superconducting wire is wound laterally, from one slot to the next, across the mandrel in outwardly progressive layers to form the wire ribbons of the coil.

5. The method of claim 1, wherein the superconducting wire is progressively wound from one slot to the next after completion of outwardly adjacent turns within each slot to serially form the wire ribbons across the mandrel.

6. The method of claim 1, wherein the mandrel includes spacing and retaining means formed of a plurality of spacing plates and mandrel spool plates sandwiched between one another to form the slots of the mandrel, and said mandrel being disassembled by sliding the respective spacing and alignment plates apart to accommodate removal of the coil ribbons from the mandrel without damaging the superconducting wire.

7. A mandrel for winding a coil of superconducting wire for a superconducting magnet having a relatively dense and uniformly spaced winding to enhance homogeneity and strength of the magnetic field surrounding the coil comprising removable spacing and retaining means forming a plurality of outwardly opening laterally parallel slots, each of said slots extending generally about the periphery of the mandrel and being sized to receive and outwardly align and retain successive turns of the superconducting wire within each slot as the wire is wound around and laterally across the mandrel to form a plurality of wire ribbons of a predetermined thickness laterally across the mandrel.

8. The mandrel of claim 7, wherein said slots formed by said removable spacing and retaining means are laterally aligned in a fashion adapted to retain and align the respective ribbons of superconducting wire in a predetermined cross-sectional profile.

9. The mandrel of claim 7, and said removable spacing and retaining means including means for passing the superconducting wire between adjacent slots.

10. The mandrel of claim 7, wherein the lateral width of said slots is substantially the same as the superconducting wire to be wound upon the mandrel to accommodate winding the wire into a single layer of outwardly adjacent turns to form the wire ribbons.

11. The mandrel of claim 7, and said removable spacing and retaining means including a plurality of spacing plates and mandrel spool plates sandwiched between one another to form the slots of the mandrel; and releasable aligning and fastening means securing said plates together.

12. The mandrel of claim 11, and said releasable aligning and fastening means including at least one mechanical fastener.

13. A coil of superconducting wire for a superconducting magnet having a relatively dense and uniformly spaced winding to enhance the homogeneity and strength of the magnetic field surrounding the coil comprising windings formed into a plurality of wire ribbons across the width of the coil, each of said wire ribbons including a predetermined number of wire turns and being aligned and bonded in an essentially side-by-side parallel fashion to the other ribbons across the width of the coil to form a coil of a predetermined cross-sectional profile.

14. The coil of claim 13, wherein the wire turns in each of said ribbons are bonded together in a single layer of outwardly adjacent wire turns.

15. The coil of claim 13, wherein said windings are wound in a racetrack-type configuration about the periphery of the coil.

16. The coil of claim 13, wherein said coil is shaped and bonded into a predetermined configuration to obtain desired magnetic field densities.

17. The coil of claim 13, wherein the superconducting wire is bonded together by means of a high temperature adhesive.

* * * * *